US005647508A

United States Patent [19]

Ronci et al.

[11] Patent Number: 5,647,508

[45] Date of Patent: Jul. 15, 1997

[54] CONTAINER DISPLAY STAND AND CONTAINERS THEREFORE

[76] Inventors: Michael Ronci, 6317 N. London Ave. #J, Kansas City, Mo. 64151; Kenneth Tarlow, 94 Birch Ave., Corte Madera, Calif. 94925

[21] Appl. No.: 520,592

[22] Filed: Aug. 30, 1995

[51] Int. Cl.[6] ..... B67D 5/06

[52] U.S. Cl. ..... 222/23; 211/74; 222/185.1; 222/322; 222/409; 222/518

[58] Field of Search ..... 222/23, 129, 132, 222/156, 158, 159, 185.1, 322, 409, 518

[56] References Cited

U.S. PATENT DOCUMENTS

| | | | |
|---|---|---|---|
| 639,746 | 12/1899 | MacDonald | 222/322 X |
| 1,206,774 | 11/1916 | Davis | 222/185.1 |
| 1,881,316 | 10/1932 | Horvath | 222/322 UX |
| 2,432,852 | 12/1947 | Arvidson | 222/409 X |
| 2,634,706 | 4/1953 | Peterson | 222/409 X |
| 3,085,718 | 4/1963 | Nelson | 222/185.1 X |
| 4,562,941 | 1/1986 | Snafilippo | 222/185.1 X |
| 4,819,815 | 4/1989 | Tarlow et al. | 211/74 |
| 4,840,143 | 6/1989 | Simon | 222/185.1 X |
| 4,928,855 | 5/1990 | Ramsey | 222/185.1 X |
| 5,139,173 | 8/1992 | Evinger | 222/156 X |
| 5,560,519 | 10/1996 | Moore et al. | 222/185.1 X |

FOREIGN PATENT DOCUMENTS

| | | | |
|---|---|---|---|
| 656636 | 5/1929 | France | 222/322 |
| 564873 | 4/1956 | Italy | 222/409 |

*Primary Examiner*—Kevin P. Shaver

[57] ABSTRACT

A container display stand and containers therefore is provided including a horizontally disposed display stand capable of supporting a number of dispensing chambers and associated containers. The top wall of the display stand is angled downward and the bottom wall of the dispensing chamber has a matching downward angle. A front ledge on the display stand prevents the dispensing chamber from sliding forward. A clip attached to the rear of the dispensing chamber clips to the top edge of the display stand which further keeps the dispensing chamber securely in position, until the user acts to remove the dispensing chamber at which time it is easily removed. A spring loaded front door and attached sliding sheet is pulled thereby exposing the vitamins or minerals or other contents located within the dispensing chamber. The funnel nature of the dispensing chamber causes only a view vitamins or minerals to appear at a time. A resilient gasket located between the open front aperture and the inner front door of the dispensing chamber keeps the contents of the dispensing chamber fresh due to the air tight nature of the closure. A clear window located at the top, leading edge of the dispensing chamber allows the user to see the last remaining contents of the dispensing chamber. Urethane feet located on the bottom of the display stand keep the display stand from sliding forward when the user slides open the door of the dispensing chamber. An adapter ring allows different size containers to be screwed onto the dispensing chamber. Self stick labels are provided to label the contents of each dispensing chamber and associated container. If the user chooses to use the containers which the vitamins or minerals originally came in, he may do so and the labels of those bottles will remain within clear sight of the user.

8 Claims, 5 Drawing Sheets

CONTAINER DISPLAY STAND AND CONTAINERS THEREFORE

BACKGROUND OF THE INVENTION

1. Field of the Invention

The invention relates to display stands and containers therefore; and, more particularly, to a stand displaying a plurality of containers allowing the contents to be selected therefrom as desired.

2. Description of Prior Art

There has been increased emphasis on good health and nutrition in recent years. The presence of certain vitamins and minerals in ones diet has bees long recognized. Many people take a number of different vitamins and minerals every day. As a general rule, such a person would have a plurality of bottles containing the different vitamins and minerals scattered about a counter or the like. The user must pick up the bottles one by one to see what vitamins and minerals he or she wants, unscrew the cap and replace the cap after taking one or more capsules of tablets out of the bottles.

Obviously, such a procedure is not very efficient and not very orderly. There is thus a need for a display rack of the like which allows one to determine quickly and easily those vitamins or minerals he or she desires to take in a neat and orderly manner. Various types of pill dispensers and the like are known in the art. These dispensers are, for the most part, individual units used to dispense pills or the like one at a time. One design described in Pat. No. 4,819,815 by Tarlow and Arner, dated Apr. 11, 1989, does address the problem of holding a plurality of containers for dispensing pills and the like, however, The bottles are hidden from view thereby causing the need for additional labels. Also the stand which holds the bottles is set to hold a fixed number of bottles without the ability to easily add bottles as necessary. In addition, the Tarlow, Arner design causes the pills contained in the bottles to clump up in a pile at the mouth of the container making it difficult to pick out one pill at a time. In addition, the Tarlow, Arner design does not allow the user to visually see if he or she is running out of pits unless the person physically opens each bottle. In addition, the construction of the slidable openings in the Tarlow, Arner design make it difficult if not impossible to produce an air tight seal between the sliding member and the bottle opening thereby causing accelerated deterioration of the contents of the bottle. The sliding closure also does not automatically reclose itself after use so the user my forget reclose a container. And finally, the design of the Tarlow, Arner patent does not allow the user to pick up a bottle one at a time if so desired. The design of the present invention is designed to overcome these and other problems which will be discussed in the description of the preferred embodiment.

SUMMARY OF THE INVENTION

It is an object of this invention to provide a display stand for displaying a plurality of containers and presenting the contents thereof for quick and easy selection.

It is a further object of this invention to provide a display stand for holding containers in such a manner that the labels on the store bought pill containers may be read.

It is a further object of this invention to provide a display stand for containers which will allow the user to remove the containers one at a time.

It is a further object of this invention to provide a display stand where the contents at the dispensing end of the container are visible without physically opening the container.

It is a further object of this invention to provide a display stand which allows the user to add containers one at a time.

It is a further object of this invention to dispense the pills in such a way that only a few pills are presented at a time making it easier for a person to remove one pill.

It is a further object of this invention to provide a display stand in which each pill dispensing drawer retracts automatically when released and creates an air tight seal upon closure.

These and other objects are preferably accomplished by providing a container display stand including a horizontally disposed stand of a length to secure one or more containers along its length. The containers and their corresponding dispensing caps are secured to the rear wall of the display stand and cradled by the stand in such a way that the containers are held in an inverted position at approximately a 45 degree angle. The dispensing caps taper toward their tips so only a few pills present themselves when a sliding drawer member is opened at the dispensing tip. A spring located inside the dispensing area causes the drawer member to automatically retract when released. A closed cell foam cell gasket is located on the inside of the drawer member so that an air tight seal is created when the door is in the closed position. The section of the dispenser closest to the drawer is clear in nature so that the user can see the last remaining pills and know exactly how many pills are left. Adapter rings allow the user to adapt the standard opening in the dispenser to conform to other smaller sized pill bottles.

DESCRIPTION OF PREFERRED EMBODIMENT

Figure 1:
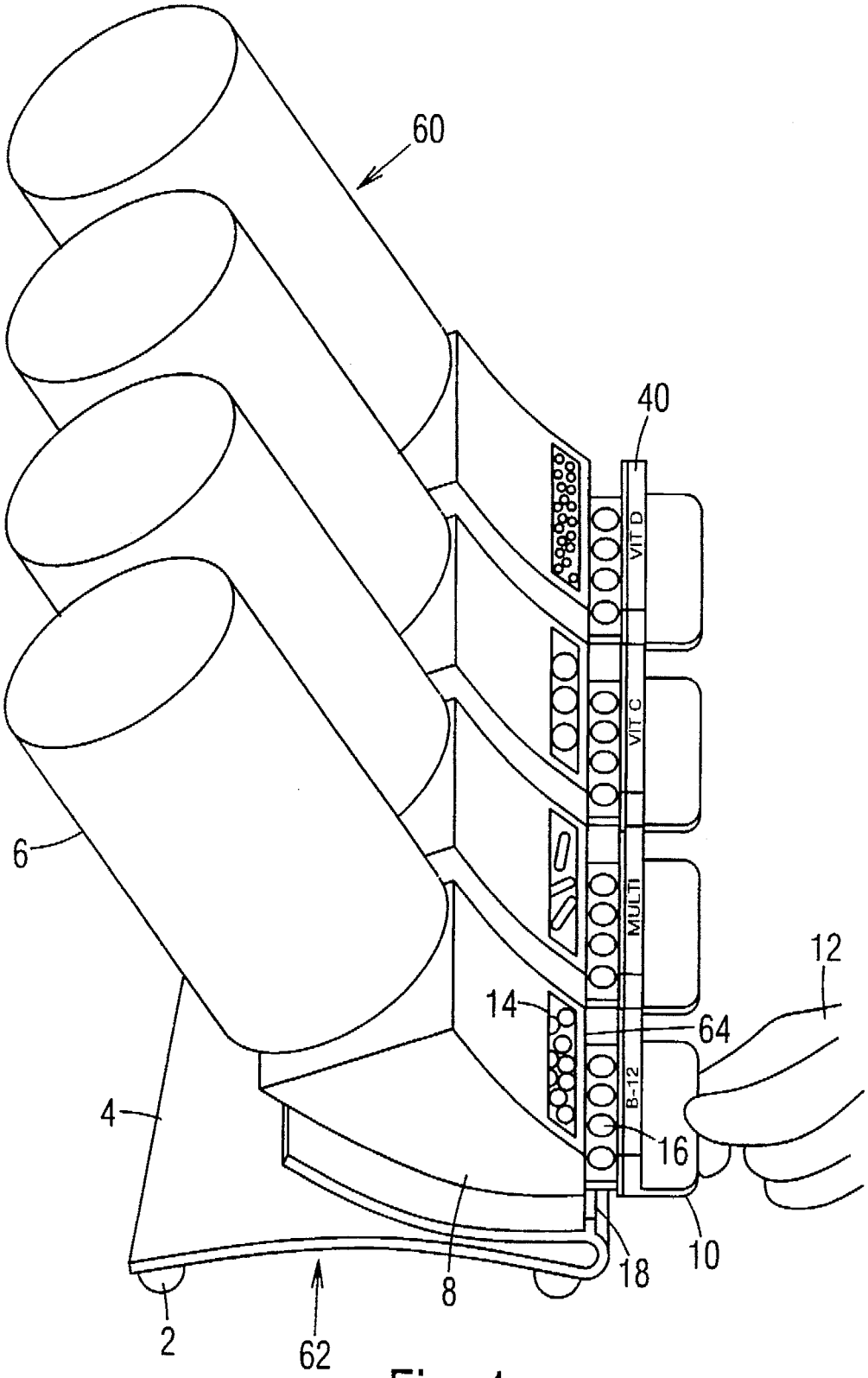
FIG. 1 is a perspective view of a display stand in accordance with the teachings of the invention.
Figure 2:
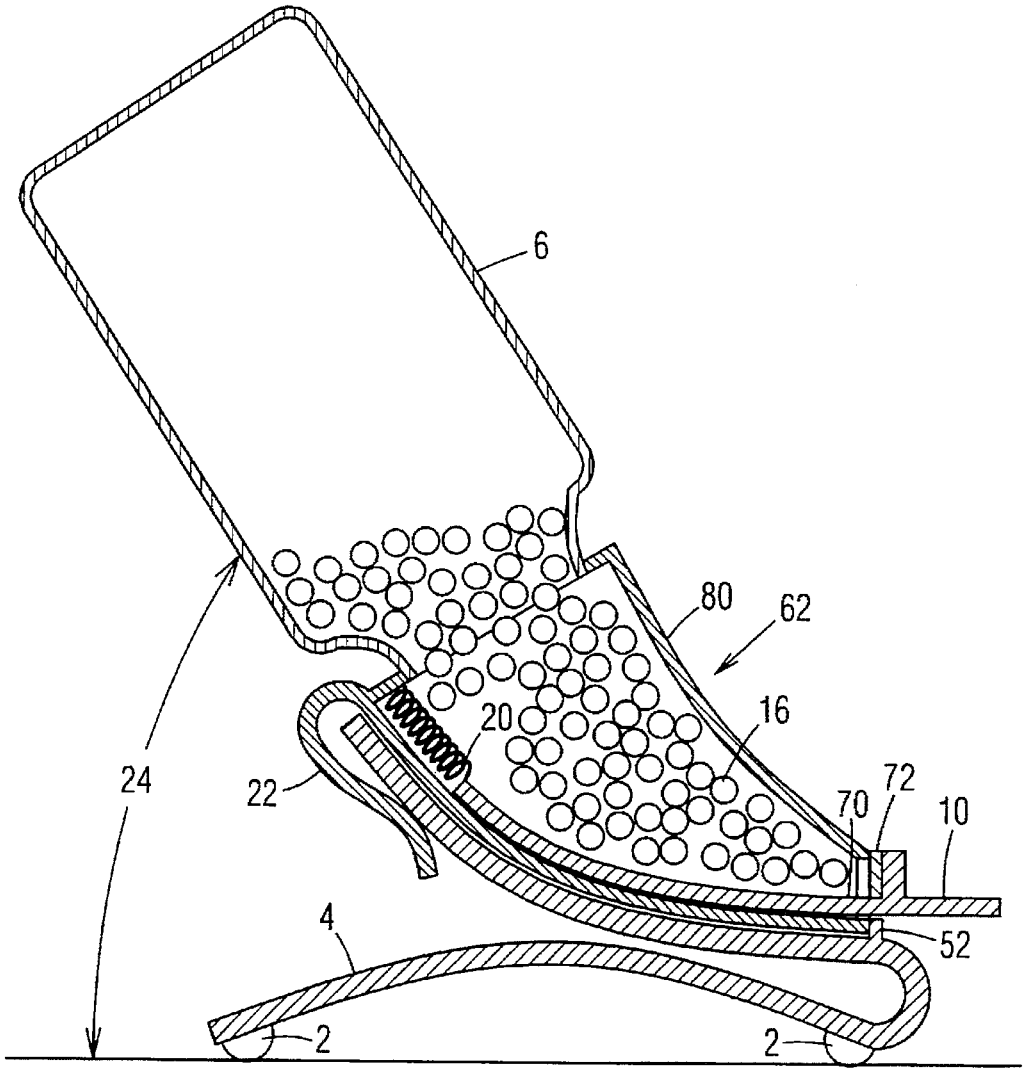
FIG. 2 is a side section view of the stand and container in the closed position.
Figure 3:
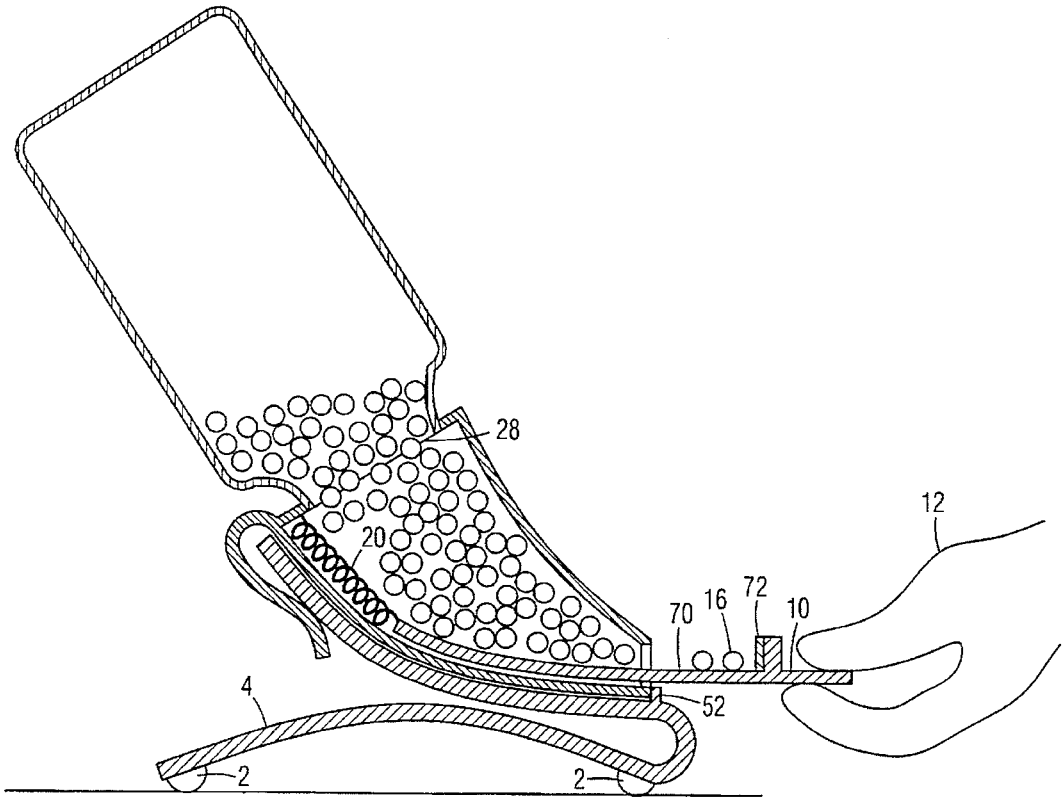
FIG. 3 is a side section view of the stand and container in the open position.
Figure 4:
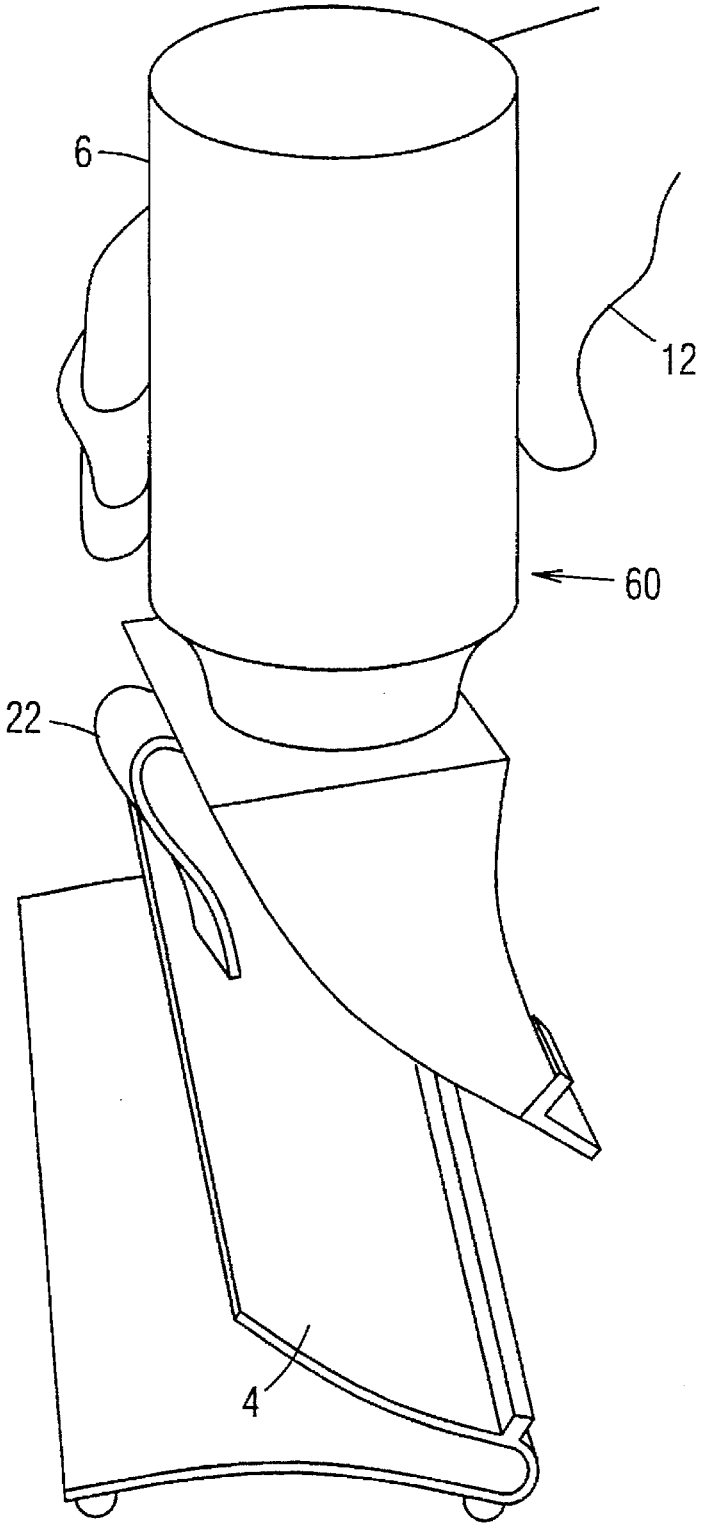
FIG. 4 is a perspective view showing a user removing a container from its stand.
Figure 5:
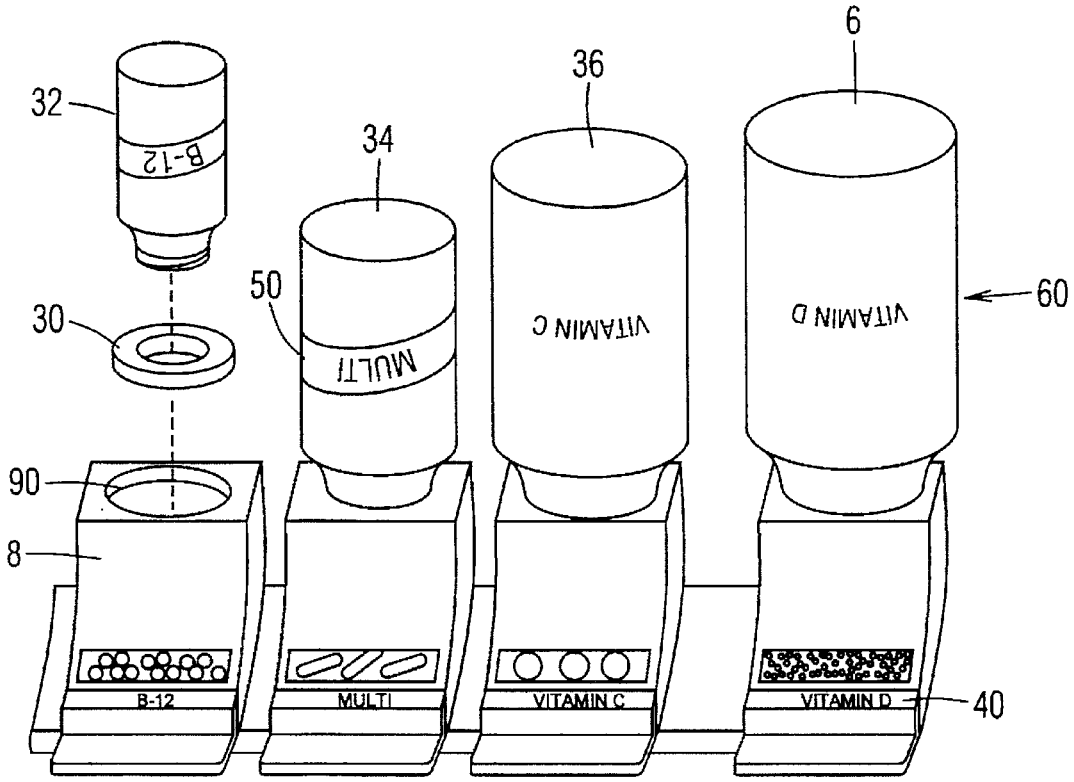
FIG. 5 is a front perspective view showing various sized bottles connected to the dispenser portion by way of adapter rings.

Referring now to FIG. 1 of the drawing, A display stand 4 supports a plurality of container units 60. Vitamin or mineral bottles 6 are attached to dispensing cap 62. To obtain a pill the user pulls on tab 10 and the pills 16 nearest to the opening 64 present themselves. Referring now to FIG. 2 of the drawing, dispenser assembly 62 is sitting on display stand 4. Bottle 6 ends up being tilted back so that is at roughly a 60 degree angle with respect to the horizontal surface which display stand 4 is resting upon. Ledge 52 keeps dispenser assembly 62 from sliding forward. Spring clip 22 grasps the upper edge of display stand 4 which holds the rear portion of dispenser assembly 62 in place. Slidable drawer or sheet 70 having a right angled front wall is held in the closed position by spring 20, Gasket 72 presses against the mouth of dispenser 62 so that an air tight closure is accomplished. Urethane bumpers 2 located on the bottom of display stand 4 keep the display stand from sliding forward when drawer tab 10 is pulled open. Pills 16 fall forward by gravity and are caused to be reduced in number as they approach the mouth of the dispenser assembly because of the tapering quality of the top wall 80 of dispensing unit 62. In this way, only a few pills present themselves when drawer 70 is pulled open. Referring now to FIG. 3, Drawer 70 is in the open position causing pills 16 to appear so that the user can pick them up. Spring 20 is in its extended position because the users fingers 12 have pulled on drawer tab 10. Urethane feet 2 keep the display stand 4 from sliding forward. Referring now to FIG. 4. the users hand 12 has grasped bottle 6 and pulled in a rearward and upward direction causing the entire bottle and dispenser assembly 60 to be removed from display stand 4. In this way, the user may add or take away bottles at any time making it easy for the user to refill bottle 6 when necessary. Referring now to FIG. 5 The person has the option to use the vitamin or mineral bottles 32,34,36 as purchased from the store or use the bottle 6 supplied with the display stand. For smaller bottles, adapter rings 30 are provided so that the smaller threads of smaller bottles 32, 34 will mate with the standard larger opening 90. The store bought bottles 32,34,36 are in full view of the user and even though the bottle labels 50 are upside down, they are still easily readable. This is an important factor when selling the display stand to a vitamin or mineral manufacturer as an advertising specialty item. Separate stick on labels 40 are provided with the display stand and dispenser assembly 60 so that the user can mark the bottles contents when using the unmarked bottle 6 that comes with the display stand. The stick on labels 40 may come pre-printed or blank in which case the user would write the name as required.

It can be seen that we have disclosed a stand and container therefore particularly suitable to displaying vitamins and minerals or other pharmaceuticals and presenting such for easy accessibility in a neat and orderly manner.

We claim:

1. A combination display stand and container comprising:

a stand having a bottom wall, a curved, upwardly slanting front wall connected to said bottom wall;

a ledge located at the leading edge of said upwardly extending front wall;

at least one container adapted to contain a plurality of discrete pellets therein disposed in at least one downwardly angled dispensing chamber consisting of a bottom wall which matches and rests on said curved, upwardly slanting front wall of said display stand, a rear wall connected to said bottom wall having an aperture which accepts the threaded neck of said at least one container, a top wall connected to said rear wall, an open front aperture extending between a left and a fight side wall, a slidable sheet resting on said bottom wall and ending in a right angled front wall, said front wall forming a closure to said front aperture, said slidable sheet extending beyond said front wall and acting as a pulling means to cause said sliding sheet to become exposed when pulled and thereby exposing pellets located on top of said slidable sheet.

2. A display stand and container as described in claim 1 wherein a gasket made of resilient material is adhered to the inner surface of said front wall and forming an air tight closure between said front wall and said front aperture of said dispensing chamber.

3. A display stand and container as described in claim 1 wherein an extension spring attached at one end to the back of said bottom wall of said dispensing chamber and at the other end to the trailing edge of said slidable sheet so that said sliding sheet and attached front wall remain fixed and sealed unless a person pulls said pulling means which would overcome said extension spring allowing said slidable sheet and said pellets resting thereon to be exposed until said person releases said pulling member.

4. A display stand and container as described in claim 1 wherein said at least one container screws into said rear wall of said dispensing chamber remains in view of a user after said at least one container is in place thereby allowing labels affixed to said at least one container to be visible.

5. A display stand and container as described in claim 1 wherein an adapter ring is used to fill a void between a smaller sized neck of said at least one container and said aperture in said top wall of said dispensing chamber.

6. A display stand and container as described in claim 1 wherein self stick labels are affixed to said dispensing chamber for the purpose of describing the contents of said dispensing chamber.

7. A display stand and container as described in claim 1 wherein a clear window is located on the top surface of said dispensing chamber allowing the user to see the last remaining contents of said dispensing chamber.

8. A display stand and container as described in claim 1 wherein resilient pads are located at the four comers of the bottom of said display stand for the purpose of keeping said display stand stationary while said user pulls on said pulling means located at the front of said dispensing chamber.

* * * * *